US006473658B1

(12) United States Patent
Bröse et al.

(10) Patent No.: US 6,473,658 B1
(45) Date of Patent: Oct. 29, 2002

(54) PROCESS AND DEVICE FOR IDENTIFICATION OR PRE-CALCULATION OF PARAMETERS OF A TIME-VARIANT INDUSTRIAL PROCESS

(75) Inventors: Einar Bröse, Erlangen (DE); Otto Gramckow, Uttenreuth (DE); Martin Schlang, München (DE); Guenter Sörgel, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/284,324

(22) PCT Filed: Oct. 7, 1997

(86) PCT No.: PCT/DE97/02297

§ 371 (c)(1),
(2), (4) Date: Jun. 2, 1999

(87) PCT Pub. No.: WO98/15882

PCT Pub. Date: Apr. 16, 1998

(30) Foreign Application Priority Data

Oct. 8, 1996 (DE) ..... 196 41 431

(51) Int. Cl.[7] ..... G05B 13/02
(52) U.S. Cl. ..... 700/31; 700/44
(58) Field of Search ..... 700/29–31, 37, 700/44, 47, 48

(56) References Cited

U.S. PATENT DOCUMENTS

| | | | | |
|---|---|---|---|---|
| 4,663,703 A | | 5/1987 | Axelby et al. | 364/149 |
| 5,043,863 A | | 8/1991 | Bristol et al. | 364/165 |
| 5,933,345 A | * | 8/1999 | Martin et al. | 364/164 |

FOREIGN PATENT DOCUMENTS

| | | |
|---|---|---|
| DE | 44 16 364 | 11/1994 |
| DE | 195 08 474 | 9/1996 |
| EP | 0 507 320 | 10/1992 |
| JP | 8-16215 | 1/1996 |
| WO | 93/25944 | 12/1993 |
| WO | 96/07126 | 3/1996 |

OTHER PUBLICATIONS

Janos Sztipanovits et al., "System Identification with Neural Network Controlled Resonator–Banks," Proceedings of the 1991 IEEE International Symposium on Intelligent Control, Aug. 13–15, 1991, pp. 158–163.

M.A. Fkirin, "Identification of Dynamic Processes at Various System Time Constants," Cybernetics and Systems, An International Journal, 22 346–356, 1991.

K.J. Hunt et al., "Neural Networks For Non–Linear Internal Model Control," IEE Proceedings–D, vol. 138, No. 5, Sep., 1991.

* cited by examiner

*Primary Examiner*—Paul P. Gordon
(74) *Attorney, Agent, or Firm*—BakerBotts LLP

(57) ABSTRACT

A method for identifying or predicting process parameters of an industrial process, in particular a primary-industry plant, having especially quickly varying process parameters or disturbances affecting the process, with the process parameters to be identified being determined by a process model as a function of measured values from the process, and with the process model having at least one time-invariant or one largely time-invariant process model which represents an image of the process averaged over time, and at least one time-variant process model that is adjusted to at least one time constant of a disturbance or of a variation in parameters of the process.

10 Claims, 4 Drawing Sheets

PROCESS AND DEVICE FOR IDENTIFICATION OR PRE-CALCULATION OF PARAMETERS OF A TIME-VARIANT INDUSTRIAL PROCESS

FIELD OF THE INVENTION

The present invention relates to a method and a device for identifying or predicting process parameters of an industrial time-variant process.

BACKGROUND INFORMATION

In regulating and controlling industrial processes, in particular primary-industry plants such as steel works, it is frequently necessary to predict certain process parameters or to identify, i.e., determine, process parameters that cannot be measured directly. In doing this, it is desirable to also identify process parameters that can be measured through technical means, but only with complicated and therefore expensive measurement techniques.

The identification of process parameters on the basis of a model is known. In this case, input quantities, or the input quantities relevant for the process parameter to be identified, are supplied to a process model that is usually simplified. However, this known method frequently causes problems in primary-industry plants. The fact that identification errors, or insufficient identification accuracy, result in high costs due to the production of rejects is characteristic of primary-industry plants, in particular steel works. The occurrence of these problems is facilitated in particular by the fact that some faults change quickly in primary-industry plants, in particular steel works, so that goods of insufficient quality may be produced during the time that is needed to adapt the process model to the new input quantities. This problem affects, in particular, rolling mills in which the operating state changes abruptly due to rolls, e.g., of a new rolling strip that is made of a new material or has a different thickness than the previous strip.

SUMMARY

An object of the present invention is to provide a method and a device that make it possible to quickly adjust identified or predicted process parameters to varying operating states of the corresponding process.

According to the present invention, this object is achieved by providing a method and a device for identifying or predicting process parameters of an industrial process, in particular a primary-industry plant, having in particular quickly varying process parameters or disturbances affecting the process, with the process parameters to be identified being determined by a process model as a function of measured values from the process, and with the process model having at least one time-invariant or one largely time-invariant process model, representing an image of the process averaged over time, and at least one time-variant process model that is adjusted to at least one time constant of a disturbance or of a variation in parameters of the process. This method has proven to be especially advantageous for identifying or predicting process parameters of a time-variant process. In this case, disturbances are interpreted as variations in the process parameters and modeled with variable model parameters, just like actual variations in the process parameters.

In one advantageous embodiment of the present invention, each significant constant of the process is assigned, in relation to the variation in the process parameters to be identified, a time-variant model that is adjusted to the corresponding time constant. By modeling each significant time constant, the process model is able to track each essential variation in the process parameters. This procedure thus makes it possible to quickly track the process model when the process undergoes rapid changes, caused, for example, by disturbances.

In a further advantageous embodiment of the present invention, the time-variant model is adjusted to a time constant, a variation or disturbance in the process in relation to the variations in the process parameters to be identified or predicted, by on-line adaptation of the time-variant model, with the cycle time of the on-line adaptation being advantageously adjusted to the time constant. Designing the time-variant model in the form of a neural network has proven to be especially advantageous.

In rolling mills, it has proven to be especially advantageous when the fastest model, i.e., the model that undergoes the most training cycles, is adapted or trained according to each rolling belt, in particular according to each rolling belt with new characteristics. Using one time-invariant model and two time-variant models in rolling mills has also proven to be advantageous.

DETAILED DESCRIPTION

Figure 1:
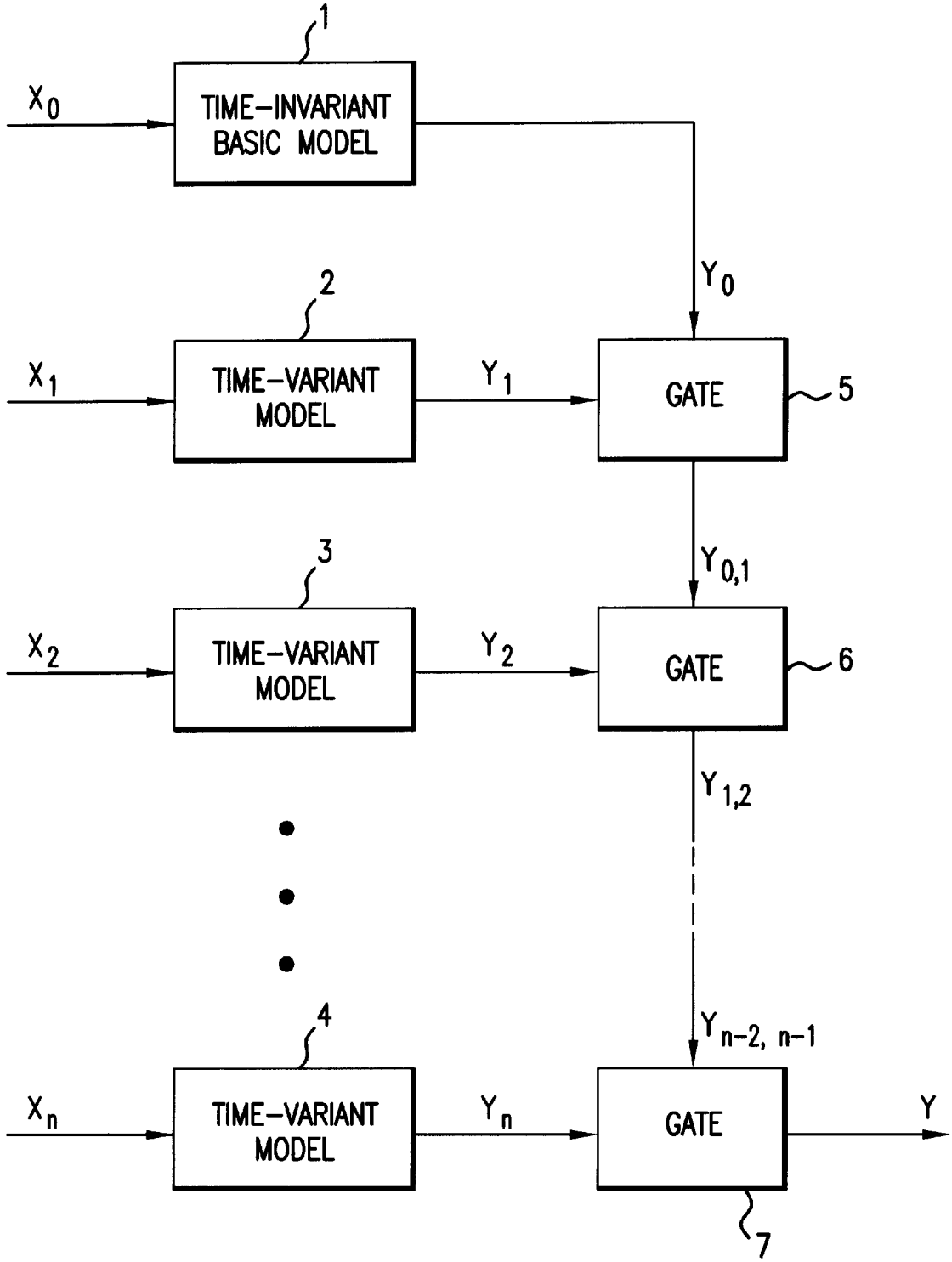
FIG. 1 shows the method according to the present invention for identifying or predicting process parameters of an industrial time-variant process.

FIG. 1 shows the method according to the present invention for identifying or predicting process parameters of an industrial time-variant process. In this case, items of process status information or measured values from the process $x_0$, $x_1, x_2, \ldots, x_n$ are supplied to a model of the process. The process status quantities or measured values from the process $x_0, x_1, x_2, \ldots, x_n$ can be different or identical quantities. These quantities can also be multi-dimensional, i.e., encompassing multiple process status quantities. The process model has a time-invariant or largely time-invariant basic model 1 of the process, which represents the industrial process averaged over a long period of time. Quantities $x_0$ and $y_0$ are input and output quantities of the time-invariant or largely time-invariant basic model. Reference numbers 2, 3, and 4 designate time-variant models that are used to calculate correction parameters $y_1, y_2, \ldots, y_n$ based on input variables $x_1, x_2, \ldots, x_n$. Time-variant models 2, 3, and 4 are adjusted to different time constants of the process so that they supply correction values $y_1, y_2, \ldots, y_n$ for different dynamic components of the process in order to correct value $y_0$ supplied by the time-invariant or largely time-invariant basic model. Correction values $y_1, y_2, \ldots, y_n$ are linked to value $y_0$ by gates 5, 6, and 7 so that a process parameter y, which contains not only the static components of the process but also the time-variant components of the process included in time-variant models 2, 3, and 4, is present at the output of final gate 7. Like values $x_0, x_1, x_2, \ldots, x_n$, value y and values $y_0, y_1, y_2, \ldots, y_n$ can be multi-dimensional quantities or scalars. It has proven to be especially advantageous for values $y_0, y_1, y_2, \ldots, y_n$ to be scalars. If multiple process parameters y are to be identified, this is advantageously accomplished by using different models, i.e., using one model according to FIG. 1 for each process parameter y. It is possible, in particular, to optimize the time-variant models in this manner to a process parameter y.

Multiplication and addition, in particular, are possible choices for gates 5, 6, and 7.

Time-invariant or largely time-invariant basic model 1 and the time-variant models can be analytic models, neural networks, or hybrid models, i.e., a combination of analytic models and neural networks. However, designing time-variant models 2, 3, and 4 as neural networks has proven to be particularly advantageous.

Time-variant sub-models 2, 3, and 4 are adapted to the real process, in particular on-line. FIG. 1 does not show this adaptation. Adapting the time-invariant or largely time-invariant basic model to the real process at specific time intervals has also proven to be advantageous.

Figure 2:
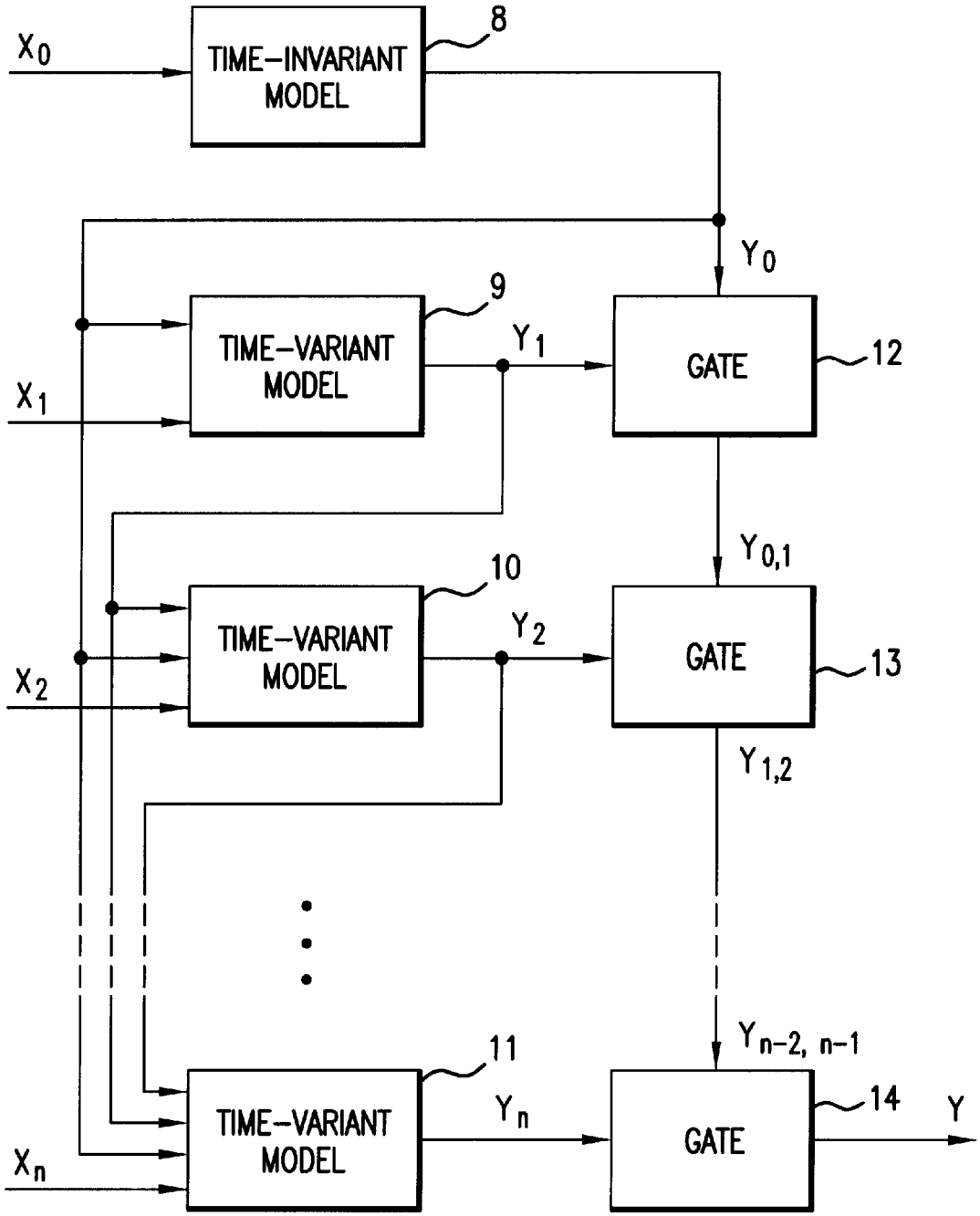
FIG. 2 shows an alternative embodiment of the method according to the present invention for identifying or predicting process parameters of an industrial time-variant process.

FIG. 2 shows an embodiment of the process according to the present invention for identifying or predicting process parameters of an industrial time-variant process as an alternative to the one illustrated in FIG. 1. As in the method shown in FIG. 1, a process parameter y is determined by a time-invariant or largely time-invariant basic model 8, time-variant models 9, 10, and 11, and gates 12, 13, and 14. Unlike the method shown in FIG. 1, output value $y_0$ of time-invariant or largely time-invariant basic model 8 and correction values $y_1, y_2, \ldots, y_{n-1}$ are supplied to time-variant model 9, 10, and 11 in addition to values $x_1, x_2, \ldots, x_n$. Once again, two alternative embodiments are possible. According to the first alternative, only the output values of the preceding model are supplied to a time-invariant model 2, 3, and 4. In other words, $x_1$ and $y_0$ are input quantities of time-variant model 9, while $x_2$ and $y_1$, are input quantities of time-variant model 10, etc. According to the second alternative, a selection of correction values $y_0, y_1, y_2, \ldots, y_{n-1}$ are supplied as input quantities to time-variant models 9, 10, and 11 in addition to input quantities $x_1, x_2, \ldots, x_n$, as shown in FIG. 2.

Figure 3:
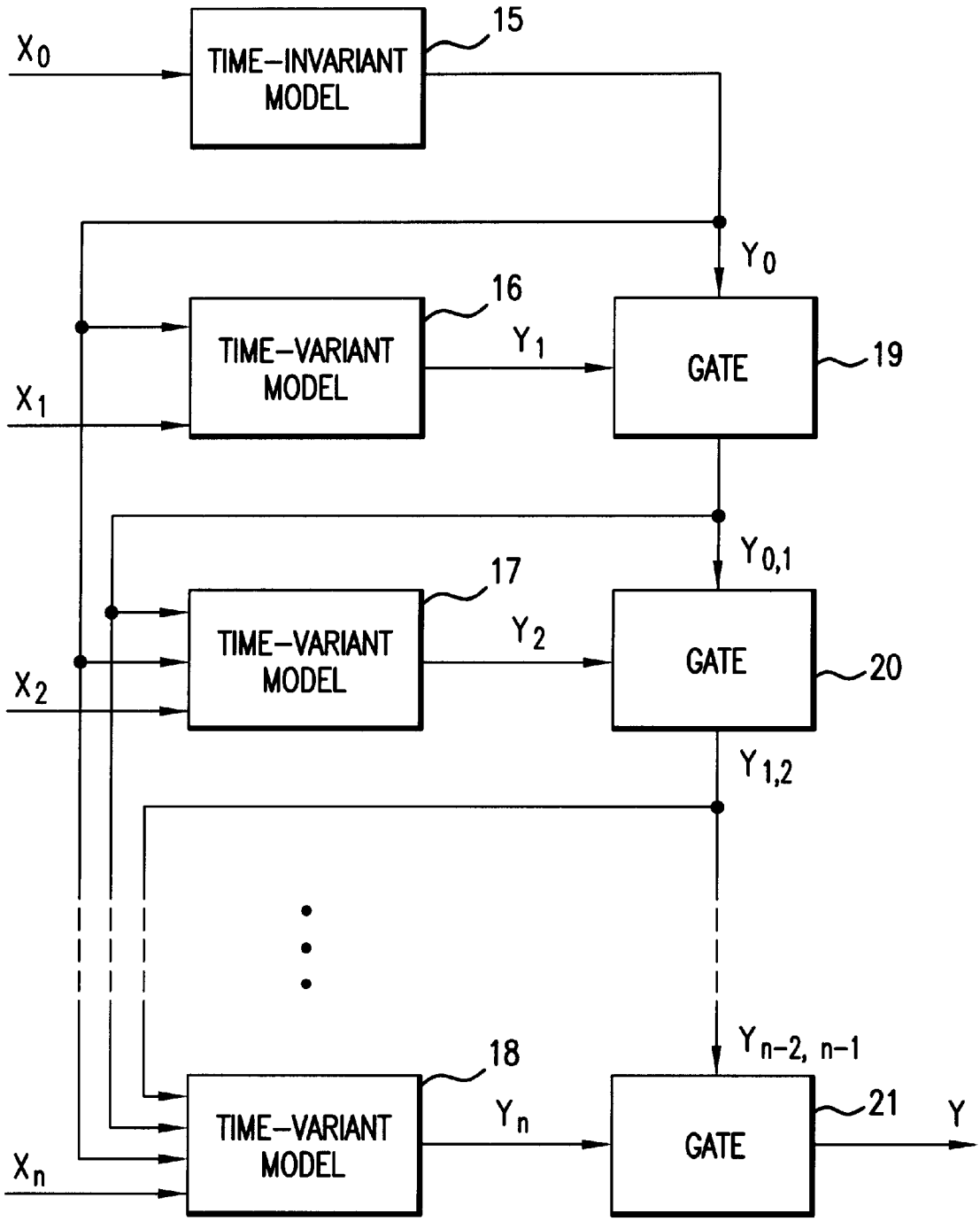
FIG. 3 shows an alternative embodiment of the method according to the present invention for identifying or predicting process parameters of an industrial time-variant process.

FIG. 3 shows an embodiment of the process according to the present invention for identifying or predicting process parameters y of a time-invariant process as an alternative to the one in FIG. 2. Once again, a process parameter y is identified by a time-invariant or largely time-invariant basic model 15, by time-variant models 16, 17, 18 and by gates 19, 20, 21. Unlike the method shown in FIG. 2, time-invariant models 17 and 18 are not supplied with correction values $y_1, y_2, \ldots, y_{n-1}$, but rather with corrected intermediate values $y_{0,1}, y_{1,2}, \ldots, y_{n-2}, y_{n-1}$. All other remarks made for FIG. 2 also apply to FIG. 3 and all other remarks made for FIG. 1 also apply to FIGS. 2 and 3.

Figure 4:
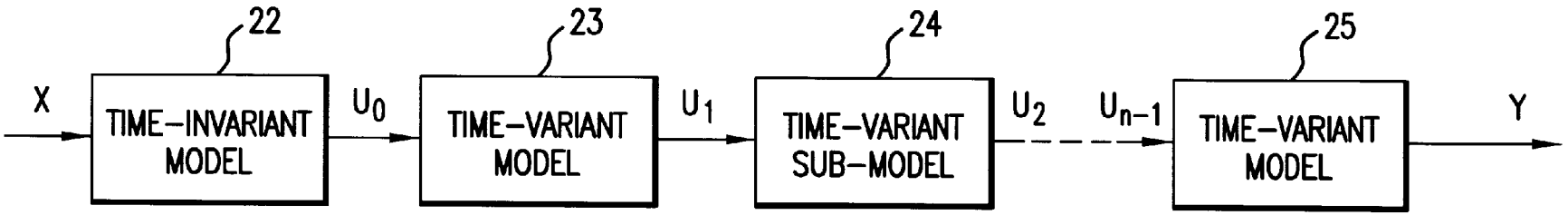
FIG. 4 shows an alternative embodiment of the method according to the present invention for identifying or predicting process parameters of an industrial time-variant process.

FIG. 4 shows a further embodiment of the method according to the present invention for identifying or predicting process parameters y of an industrial time-variant process. In this case, items of process status information or measured values from process x are supplied to a time-invariant or largely time-invariant model 22 of the process. This model identifies an intermediate value $u_0$, which is supplied to a time-variant model 23. Time-variant model 23 identifies an intermediate value $u_1$, which has been corrected by the dynamic component of the process modeled in model 23, with this intermediate value, in turn, being supplied to a further time-variant sub-model 24. This sub-model identifies an intermediate value $u_2$, which has been corrected by the dynamic component of the process modeled in sub-model 24, etc. In the end, final sub-model 25 outputs a value y for parameter y to be identified, which contains the dynamic components derived from time-variant models 23, 24, and 25.

The embodiments of the method according to the present invention shown in FIGS. 1 through 4 are suitable not only for identifying, i.e., determining, process parameters but in particular for predicting them as well.

What is claimed is:

1. A method for identifying or predicting process parameters for an industrial process having variable process parameters or disturbances affecting the industrial process, comprising the steps of:

measuring values from the industrial process;

determining the process parameters as a function of the measured values using a process model, the process model including at least one substantially time-invariant model representing an image of the industrial process averaged over time, and at least one time-variant process model; and adjusting the at least one time-variant process model to at least one time constant of one of a disturbance and a variation in parameters of the process.

2. The method according to claim 1, wherein the industrial process is a primary-industry plant.

3. The method according to claim 1, wherein at least one of the substantially time-invariant process model and the at least one time-variant process model includes one of an analytic model, a neural network, and a hybrid model, the hybrid model including the analytic model and the neural network.

4. The method according to claim 1, further comprising the step of adapting the substantially time-invariant process model and the at least one time-variant process model to an instantaneous industrial process at a particular instant in time, and wherein the time-variant process model is adapted by on-line training.

5. The method according to claim 1, further comprising linking, via one of addition and multiplication, the determined process parameters to a correction term, the correction term being formed by a process model as a function of the measured values, the process model including a neural network; and adapting the process model system to an on-line process, wherein the on-line process is the industrial process in operation.

6. The method according to claim 1, wherein the process parameters are predicted by one of the substantially time-invariant process model and the at least one time-variant process model.

7. The method according to claim 1, further comprising adapting the substantially time-invariant process model to the industrial process.

8. The method according to claim 1, wherein the adjusting step includes the step of adjusting each of the at least one time-variant process model assigned a shorter time constant more frequently than adjusting each of the at least one time-variant process model assigned a longer time constant.

9. A device for identifying or predicting process parameters of an industrial process having variable process parameters, comprising:

a process model determining the process parameters as a function of measured values from the industrial process, the process model including at least one substantially time-invariant process model representing an image of the industrial process averaged over time, and at least one time-variant process model, the at least one time-variant model being adjusted to at least one time constant of one of a disturbance and a variation in parameters of the industrial process.

10. The device according to claim 9, wherein the industrial process is a primary-industry plant.

* * * * *